US010980091B1

(12) United States Patent
Zhu et al.

(10) Patent No.: US 10,980,091 B1
(45) Date of Patent: Apr. 13, 2021

(54) LIGHT SOURCE DEVICE

(71) Applicant: KAISTAR Lighting (Xiamen) Co., Ltd., Xiamen (CN)

(72) Inventors: Xiaolei Zhu, Xiamen (CN); Xiaoming Zhao, Xiamen (CN); Francis Daw Heng Wong, Xiamen (CN)

(73) Assignee: KAISTAR LIGHTING (XIAMEN) CO., LTD., Xiamen (CN)

( * ) Notice: Subject to any disclaimer, the term of this patent is extended or adjusted under 35 U.S.C. 154(b) by 0 days.

(21) Appl. No.: 16/878,133

(22) Filed: May 19, 2020

(30) Foreign Application Priority Data

Sep. 20, 2019 (CN) ..... 201910893277.4

(51) Int. Cl.
*H05B 45/20* (2020.01)
*H05B 45/44* (2020.01)
*H05B 45/48* (2020.01)

(52) U.S. Cl.
CPC ..... *H05B 45/20* (2020.01); *H05B 45/44* (2020.01); *H05B 45/48* (2020.01)

(58) Field of Classification Search
None
See application file for complete search history.

(56) References Cited

U.S. PATENT DOCUMENTS

2018/0368220 A1* 12/2018 Shuai ..... H05B 45/10

* cited by examiner

*Primary Examiner* — Dedei K Hammond
(74) *Attorney, Agent, or Firm* — Hemisphere Law, PLLC; Zhigang Ma

(57) ABSTRACT

A light source device includes: a power supply circuit, having a first voltage terminal and a second voltage terminal; a light source circuit, having a common terminal and multiple branch terminals, the common terminal being electrically connected to the first voltage terminal, the light source circuit including multiple light sources for emitting lights of different colors, first terminals of the light sources being electrically connected to the common terminal, and second terminals of the light sources being electrically connected to the branch terminals respectively; and a light adjusting circuit, including multiple electrical paths and being electrically connected to the second voltage terminal and the branch terminals via the electrical paths so that the light sources are connected in parallel between the first and second voltage terminals. A resistance of at least one of the electrical paths is adjustable to set branch currents respectively flowing through the light sources.

11 Claims, 6 Drawing Sheets

LIGHT SOURCE DEVICE

FIELD OF THE DISCLOSURE

The disclosure relates to the field of light source and lighting technologies, and more particularly to a light source device.

BACKGROUND

With the popularization of LED (Light emitting diode) products, there are increasing demands for adjustable color temperature of LED light sources. There are various requirements for adjustment of color temperature, some of which is that the color temperature is arbitrarily adjusted within a certain range, and some of which is that the color temperature is adjusted by setting multi-levels of color temperature within a range of color temperature. The conventional multi-level color temperature adjustment method is realized by re-designing a power supply circuit of a LED light source to add a control circuit in the power supply circuit. However, the added control circuit includes a MCU or a MOS transistor(s) with relatively high cost transistor(s), resulting in less design flexibility of the LED light source of multi-level color temperature adjustment and higher material cost. Therefore, how to realize an LED light source of multi-level color temperature adjustment at a relatively low cost is a technical problem needed to be solved.

SUMMARY

Accordingly, in order to overcome defects and deficiencies in the prior art, embodiments of the disclosure provide a light source device, so as to achieve the purposes of reducing cost and improving product design flexibility.

Specifically, a light source device according to an embodiment of the disclosure, for example, includes: a power supply circuit, a light source circuit and a light adjusting circuit. The power supply circuit has a first voltage terminal and a second voltage terminal. The light source circuit has a common terminal and a plurality of branch terminals. The common terminal is electrically connected to the first voltage terminal, the light source circuit includes a plurality of light sources configured for emitting lights of different colors, first terminals of the plurality of light sources are electrically connected to the common terminal, and second terminals of the plurality of light sources are electrically connected to the plurality of branch terminals respectively. The light adjusting circuit includes a power connection terminal, a plurality of light source branch connection terminals and a plurality of electrical paths. The power connection terminal is electrically connected to the second voltage terminal, the plurality of light source branch connection terminals are respectively connected to the plurality of branch terminals. First terminals of the plurality of electrical paths are electrically connected to the plurality of light source branch connection terminals respectively and second terminals of the plurality of electrical paths are electrically connected to the power connection terminal, and thereby the plurality of light sources are connected in parallel between the first voltage terminal and second voltage terminal; A resistance of at least one of the plurality of electrical paths is adjustable to thereby set magnitudes of branch currents respectively flowing through the plurality of light sources.

In an embodiment of the disclosure, the plurality of light sources include a first light source and a second light source, the plurality of electrical paths include a first electrical path and a second electrical path, the first electrical path is electrically connected to the first light source through corresponding one of the plurality of light source branch connection terminals, the second electrical path is electrically connected to the second light source through corresponding one of the plurality of light source branch connection terminals, the resistance of the first electrical path is adjustable and the first electrical path includes a first switch cooperative with a plurality of resistors of different resistances to form a plurality of electrical sub-paths connected in parallel, and the second electrical path includes a second switch.

In an embodiment of the disclosure, the first switch includes a plurality of switch units in a multi-channel switch, at least a part of the plurality of switch units with the plurality of resistors of different resistances together form the plurality of electrical sub-paths connected in parallel, and the second switch includes one or more than one switch unit in the multi-channel switch.

In an embodiment of the disclosure, the resistance of the second electrical path is adjustable, and the second switch with a plurality of another resistors of different resistances together form a plurality of another electrical sub-paths connected in parallel.

In an embodiment of the disclosure, the resistance of the second electrical path is non-adjustable.

In an embodiment of the disclosure, the light adjusting circuit further includes a second power connection terminal, a light source common connection terminal and a third switch electrically connected between the second power connection terminal and the light source common connection terminal The second power connection terminal is electrically connected to the first voltage terminal, and the light source common connection terminal is electrically connected to the common terminal.

In an embodiment of the disclosure, the plurality of light sources include a first light source and a second light source, the plurality of electrical paths include a first electrical path and a second electrical path, the first electrical path is electrically connected to the first light source through corresponding one of the plurality of light source branch connection terminals, the second electrical path is electrically connected to the second light source through corresponding one of the plurality of light source branch connection terminals. At least one of the first electrical path and the second electrical path is disposed with an adjustable resistor.

In an embodiment of the disclosure, the first electrical path and the second electrical path are disposed with adjustable resistors respectively.

In an embodiment of the disclosure, the light adjusting circuit further includes a second power connection terminal, a light source common connection terminal and a main switch electrically connected between the second power connection terminal and the light source common connection terminal. The second power connection terminal is electrically connected to the first voltage terminal, and the light source common connection terminal is electrically connected to the common terminal.

In an embodiment of the disclosure, the light adjusting circuit further includes a second power connection terminal, a light source common connection terminal and a main switch electrically connected between the second power connection terminal and the light source common connection terminal. The second power connection terminal is electrically connected to the first voltage terminal, and the light source common connection terminal is electrically connected to the common terminal.

In an embodiment of the disclosure, the first voltage terminal is one of a direct current (DC) output terminal and a ground terminal, and the second voltage terminal is the other one of the DC output terminal and the ground terminal.

In an embodiment of the disclosure, the plurality of light sources include a first light source and a second light source, the first light source and the second light source respectively include a same number or different numbers of serially connected light emitting diodes, the plurality of electrical paths include a first electrical path and a second electrical path, the first electrical path is electrically connected to the first light source through corresponding one of the plurality of light source branch connection terminals, the second electrical path is electrically connected to the second light source through corresponding one of the plurality of light source branch connection terminals. A voltage difference between the first light source and the second light source is 0-5 times of a junction voltage of one of the light emitting diodes.

In an embodiment of the disclosure, a resistor for color-adjustment required for adjusting the first light source and the second light source to form a mixed light with a target color temperature satisfies a relationship that: $Rx=(Vr/I)*K$, where Rx represents resistance of the resistor for color-adjustment, Vr represents the voltage difference, I represents a total current flowing through the plurality of light sources, and K represents a branch current adjustment coefficient.

It can be seen from the embodiments above that, the plurality of light sources in the light source circuit are connected in parallel between the first voltage terminal and the second voltage terminal of the power supply circuit through respective electrical paths in the light adjusting circuit, that is the light adjusting circuit configured as a multi-level color adjustment control circuit is established between the power supply circuit and the light source circuit, magnitudes of branch currents flowing through the light sources in the light source circuit are adjusted by adjusting resistance(s) of the electrical path(s) with adjustable resistance(s) in the light adjusting circuit; and the light adjusting circuit configured as a multi-level color adjustment control circuit can be realized by using electronic component(s) with relatively low cost. In this way, design of the light source device of multi-level color adjustment can be more flexible, which saves design time, and cost of the light source device can be reduced, good economic and social benefits are created while more material resources are saved.

BRIEF DESCRIPTION OF THE DRAWINGS

In order to more clearly illustrate technical solutions of embodiments of the disclosure, drawings used in the embodiments will be briefly introduced below. Apparently, the drawings in the description below are merely some embodiments of the disclosure, a person skilled in the art can obtain other drawings according to these drawings without creative efforts.

DETAILED DESCRIPTION OF EMBODIMENTS

Technical solutions of embodiments of the disclosure will be clearly and fully described in the following with reference to the accompanying drawings in the embodiments of the disclosure. Apparently, the described embodiments are some of the embodiments of the disclosure, but not all of the embodiments of the disclosure. All other embodiments obtained by the skilled person in the art based on the described embodiments of the disclosure without creative efforts are within the scope of protection of the instant application.

First Embodiment

Figure 1:
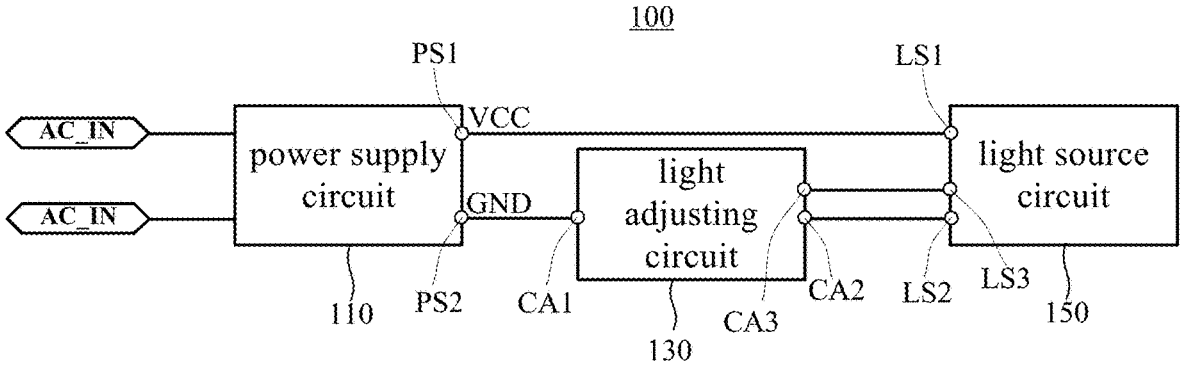
FIG. 1 is a schematic circuit block diagram of a light source device according to a first embodiment of the disclosure.

As shown in FIG. 1, a light source device 100 in the first embodiment of the disclosure includes: a power supply circuit 110, a light adjusting circuit 130, and a light source circuit 150.

The power supply circuit 110 has alternating current (AC) input terminals AC_IN and voltage terminals PS1 and PS2. The voltage terminal PS1 is for example a direct current (DC) output terminal VCC, the voltage terminal PS2 is for example a ground terminal GND. Furthermore, an output current of the power supply circuit 110 in the first embodiment is constant, or the power supply circuit 110 is called as a constant current output power supply circuit, which can be an conventional mature constant current power supply such as a light emitting diode (LED) constant current drive power supply with a DC voltage of 24V-36V, there are no more details here.

The light adjusting circuit 130 has a power connection terminal CA1 and a plurality of light source branch connection terminals such as CA2 and CA3. The power connection terminal CA1 is electrically connected to the voltage terminal PS2 of the power supply circuit 110 such as the ground terminal GND.

The light source circuit 150 has a common terminal LS1 and a plurality of branch terminals such as LS2 and LS3. The common terminal LS1 is electrically connected to the voltage terminal PS1 of the power supply circuit 110 such as the DC output terminal VCC; the branch terminals LS2 and LS3 are respectively electrically connected to the light source branch connection terminals CA2 and CA3 of the light adjusting circuit 130.

Figure 2:
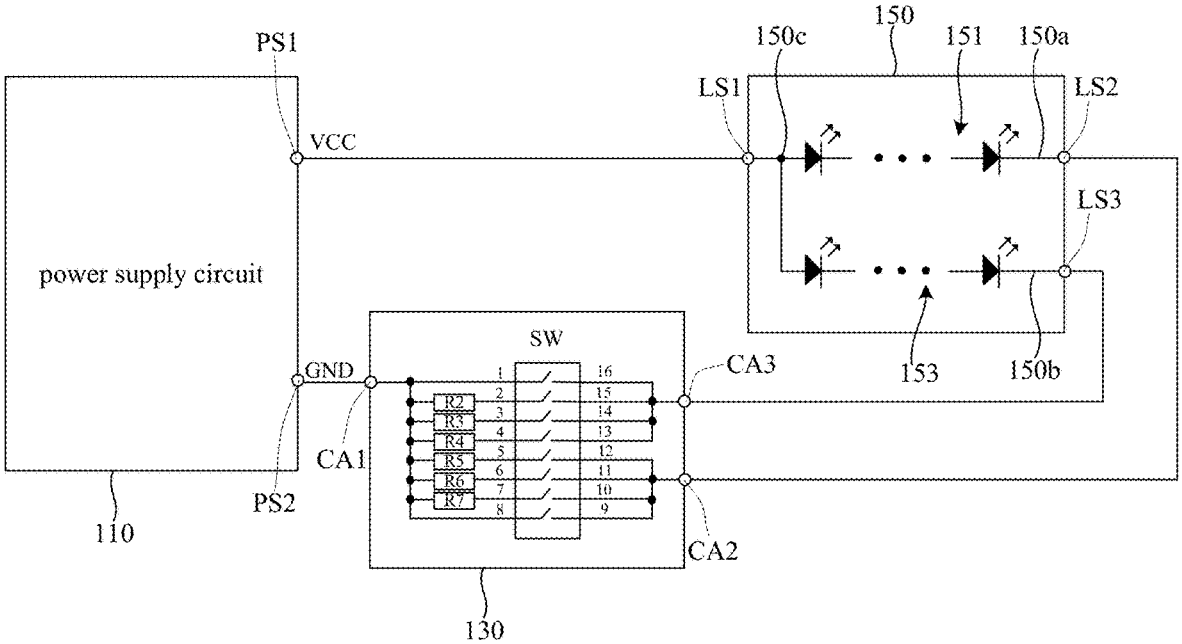
FIG. 2 is a schematic circuit diagram of a specific implementation of the light source device shown in FIG. 1.

Referring to FIG. 2, it is a specific implementation of the light source device 100 shown in FIG. 1. In FIG. 2, the light source circuit 150 includes a light source 151 and a light source 153, and the light source 151 and the light source 153 are configured for emitting lights of different colors; for example a light emitted from the light source 151 is a white light with a color temperature of 2700K, and a light emitted from the light source 153 is a white light with a color temperature of 5000K. The light source 151 and the light source 153 for example respectively have LED lamp strings of a same number or different numbers of serially connected LED lamps, a voltage of one of the LED lamps (or called as a junction voltage) is for example 3V or 9V. Furthermore, terminals 150*c* of light source 151 and 153 are electrically connected to the common terminal LS1, terminals 150*a* and 150*b* of the light sources 151 and 153 are electrically connected to the branch terminals LS2 and LS3 respectively.

By above, in FIG. 2, the light adjusting circuit 130 includes two electrical paths of adjustable resistances, one of the two electrical paths is connected between the power connection terminal CA1 and the light source branch connection terminal CA2 so as to be connected serially with the light source 151 between the DC output terminal VCC and the ground terminal GND, the other one of the two electrical paths is connected between the power connection terminal CA1 and the light source branch connection terminal CA3 so as to be connected serially with the light source 153 between the DC output terminal VCC and the ground terminal GND. Concretely, the electrical path connected between the power connection terminal CA1 and the light source branch connection terminal CA2 includes four electrical sub-paths connected in parallel. Three of the four electrical sub-paths respectively include three switch units in a multi-channel switch SW and resistors R5, R6 and R7 respectively connected serially with the three switch units, the other of the four electrical sub-paths includes another switch unit in the multi-channel switch SW. Similarly, the electrical path connected between the power connection terminal CA1 and the light source branch connection terminal CA3 includes four electrical sub-paths connected in parallel. Three of the four electrical sub-paths respectively include three switch units in the multi-channel switch SW and resistors R2, R3 and R4 respectively connected serially with the three switch units, and the other of the four electrical sub-paths includes another switch unit in the multi-channel switch SW. The multi-channel switch here is for example an eight-digit dial switch. In other alternative implementation(s), the four switch units in each electrical path may also be realized by a single four-channel rotary switch. The two electrical paths in the light adjusting circuit 130 of the light source device shown in FIG. 2 are for example electrical paths of four-level adjustable resistance respectively.

Figure 3:
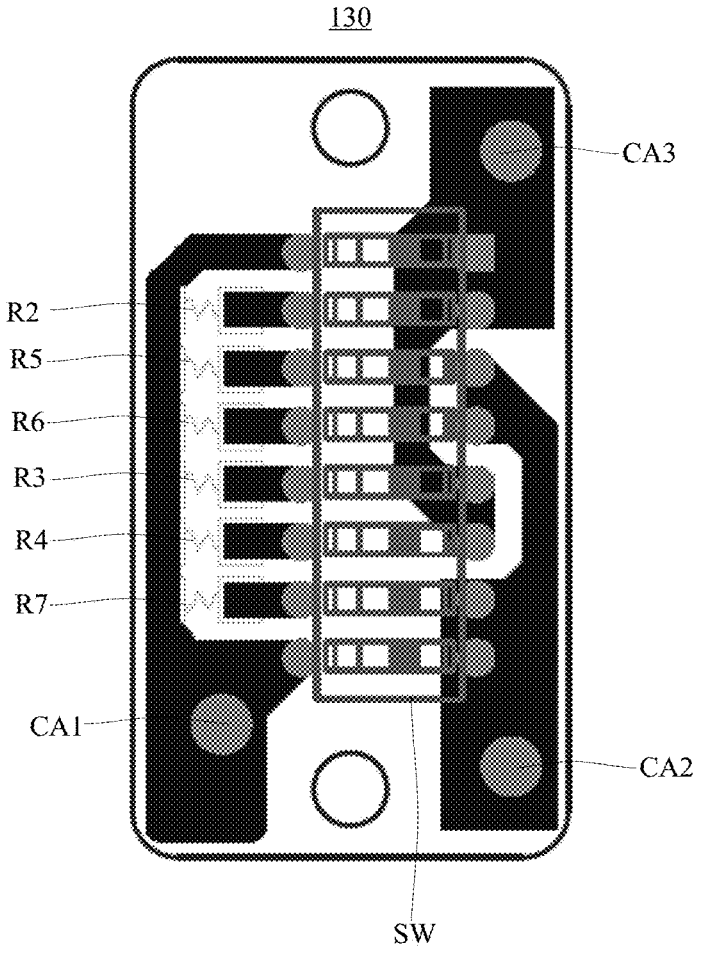
FIG. 3 is a schematic layout diagram of a printed circuit board of a light adjusting circuit shown in FIG. 2.

Referring to FIG. 3, it is a schematic layout diagram of a printed circuit board (PCB) of the light adjusting circuit 130 shown in FIG. 2. The power connection terminal CA1, the light source branch connection terminals CA2 and CA3, the resistors R2-R7 and the multi-channel switch SW on the two electrical paths of the light adjusting circuit 130 are all set on the same circuit board.

Figure 4:
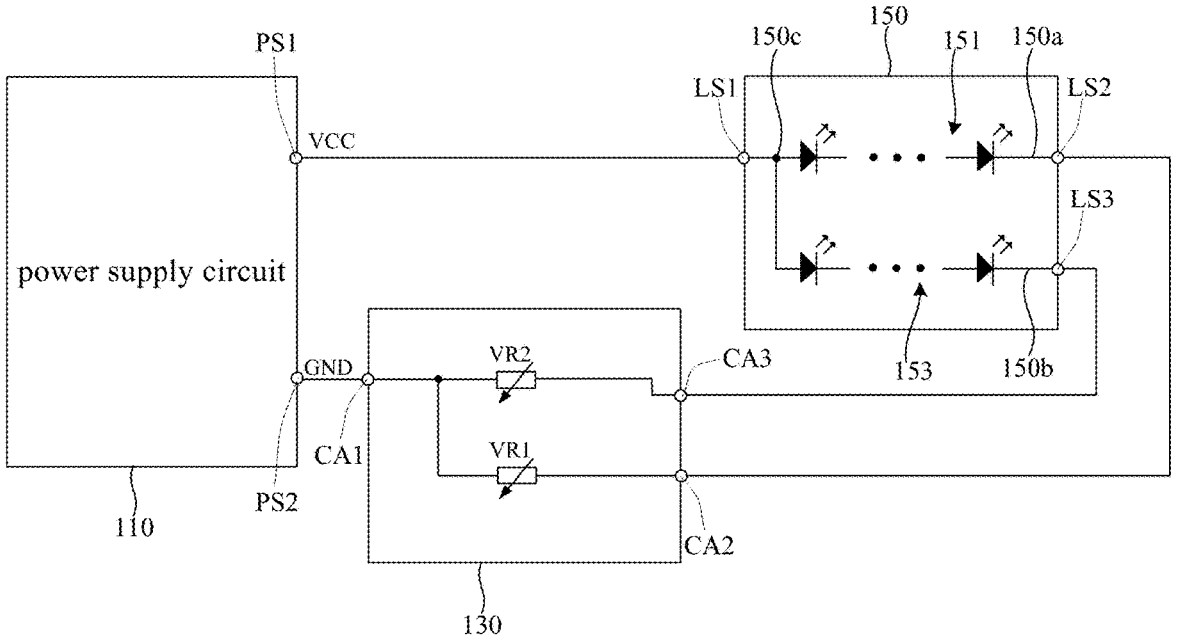
FIG. 4 is a schematic circuit diagram of another specific implementation of the light source device shown in FIG. 1.

Referring to FIG. 4, it is another specific implementation of the light source device 100 shown in FIG. 1. In FIG. 4, regarding the light adjusting circuit 130, the electrical path connected between the power connection terminal CA1 and the light source branch connection terminal CA2 is disposed with an adjustable resistor VR1, so that a resistance of the electrical path is adjustable. Similarly, the electrical path connected between the power connection terminal CA1 and the light source branch connection terminal CA3 is disposed with an adjustable resistor VR2, so that a resistance of the electrical path is adjustable.

Figure 5:
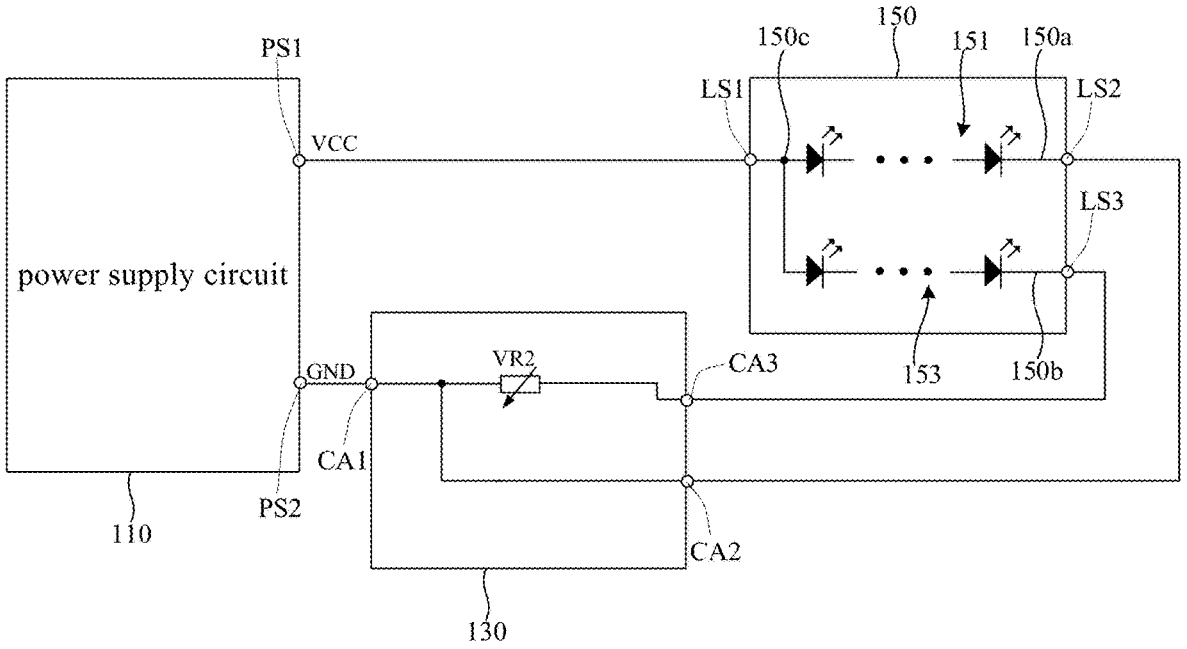
FIG. 5 is a schematic circuit diagram of still another specific implementation of the light source device shown in FIG. 1.

Referring to FIG. 5, it is another specific implementation of the light source device 100 shown in FIG. 1. In FIG. 5, regarding the light adjusting circuit 130, a resistance of the electrical path connected between the power connection terminal CA1 and the light source branch connection terminal CA2 is fixed, so that the resistance of the electrical path is non-adjustable. Furthermore, the electrical path connected between the power connection CA1 and the light source branch connection CA3 is disposed with the adjustable resistor VR2, so that a resistance of the electrical path is adjustable.

In the light source device 100 aforementioned of this embodiment, the plurality of light sources such as 151 and 153 in the light source circuit 150 are connected in parallel between the voltage terminal PS1 and the voltage terminal PS2 of the power supply circuit 110 through their respective electrical paths in the light adjusting circuit 130, that is the light adjusting circuit 130 configured as a multi-level color adjustment control circuit is established between the power supply circuit 110 and the light source circuit 150, magnitudes of branch currents flowing through the light sources such as 151 and 153 in the light source circuit 150 are adjustable by adjusting resistances of the electrical path(s) with adjustable resistance(s) in the light adjusting circuit 130; and the light adjusting circuit 130 configured as a multi-level color adjustment control circuit does not need to include a MCU and a MOS transistor(s) and other electronic components with relatively high cost. In this way, design of the light source device 100 of multi-level color adjustment can be more flexible, which saves design time, and cost of the light source device 100 such as an LED light source can be reduced, good economic and social benefits are created while more material resources are saved. Taking the light source 151 as an LED white light source with a color temperature of 2700K and the light source 153 as another LED white light source with a color temperature of 5000K as an example, by adjusting resistance(s) of the electrical path(s) of adjustable resistance, mixed white lights with 3000K color temperature, 4500K color temperature or other color temperatures between 2700K-5000K can be formed with a constant total output current I of the power supply circuit 110. In order to express more clearly, a concept of shunt voltage difference is introduced here. The definition of the shunt voltage difference is voltage difference between respective total voltages of light sources with two color temperatures in the light source circuit (such as a total junction voltage of each LED string); a conventional method is to make light sources with two color temperatures be of the same number of LED lamps, the same serial-parallel relationship, and make light source with each color temperature be of the same range of voltage range, that is a conventional technology cannot control shunt voltage differences of light sources with two color temperatures. Nevertheless, the embodiment of the disclosure precisely aims to intentionally control shunt voltage differences of light sources with two color temperatures in the power supply circuit, for example consciously control shunt voltage differences Vr with two color temperatures to 0-5 times of voltage of one of LED lamps in light source (or called as a junction voltage) such as 0-15V (corresponding to one of LED lamps junction voltage is 3V) or 0-45V (corresponding to one of LED lamps junction voltage is 9V). Suppose that a color adjustment resistor required for adjusting the light sources 151 and 153 to form a mixed light with a target color temperature is Rx, then it satisfies a relationship that: $Rx=(Vr/I)*K$, where K represents a branch-current adjustment coefficient or branch-current adjustment factor; a resistance of the electrical path in the light adjusting circuit 130 is set based on a resistance of Rx, which can achieve light adjustment for example color temperature adjustment, because the total output current I will be shunted in a certain proportion to light sources with two color temperatures based on the resistance of Rx, however color temperature of the mixed light will also be different when branch-currents flowing through light sources with the two color temperatures are different, thereby which achieves color temperature adjustment. In short, by controlling the resistance of Rx, any proportion of current adjustment can be achieved with an unchanging total output current I.

In addition, the aforementioned color temperatures of 2700K and 5000K can be extended to any color temperature or even a colored light for LED grow light. The realization method of the colored light used for the LED grow light for example is as follows: when two light sources of 660 nm (deep red) and 730 nm (far red) are used, a light quantum ratio (color matching) of a flowering stage of a plant is 4:1, and another light quantum ratio of a fruiting period of the plant is 5:2; or when two light sources of 460 nm (blue) and 660 (dark red) are used, a light quantum ratio (color matching) of a nursery period of a plant is 3:2, and another photon ratio of a leaf growing period of the plant is 2:1; but this disclosure does not take these as limits.

Furthermore, the light source device 100 of the embodiment of the disclosure can be applied to most bulbs and lamps with requirement for multi-level color adjustment function, such as panel light (FPL2), downlight, spotlight, ceiling light, track light, strip lamp, plant bulb, plant lamp, etc.

Second Embodiment

Figure 6:
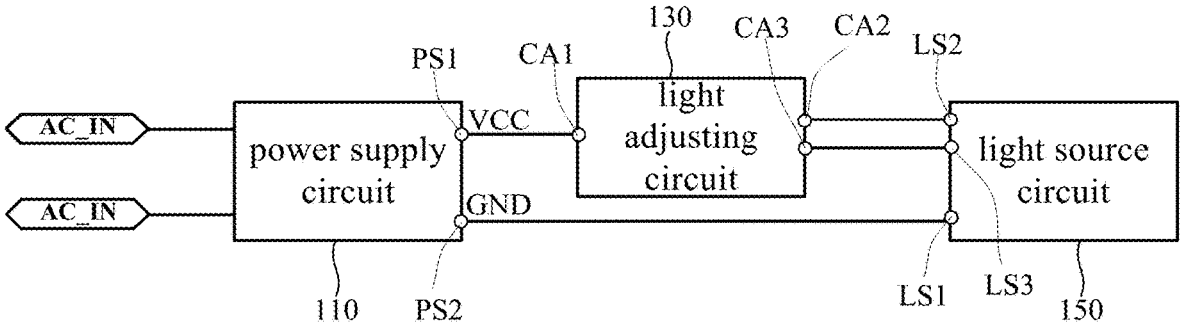
FIG. 6 is a schematic circuit block diagram of a light source device according to a second embodiment of the disclosure.

Referring to FIG. 6, a light source device in the second embodiment of the disclosure also includes: a power supply circuit 110, a light adjusting circuit 130, and a light source circuit 150. The differences from the foregoing first embodiment are that: a power supply terminal CA1 of the light adjusting circuit 130 is electrically connected to a voltage terminal PS1 of the power supply circuit 110 such as a DC output terminal VCC instead of a voltage terminal PS2, and accordingly a common terminal LS1 of the light source circuit 150 is electrically connected to the voltage terminal PS2 of the power supply circuit 110 such as a ground terminal GND instead of the voltage terminal PS1. In addition, internal structures of the light adjusting circuit 130 and the light source circuit 150 of the second embodiment are the same as that of the first embodiment, which are shown in FIG. 2, FIG. 4 and FIG. 5, there are no more details here.

Third Embodiment

Figure 7:
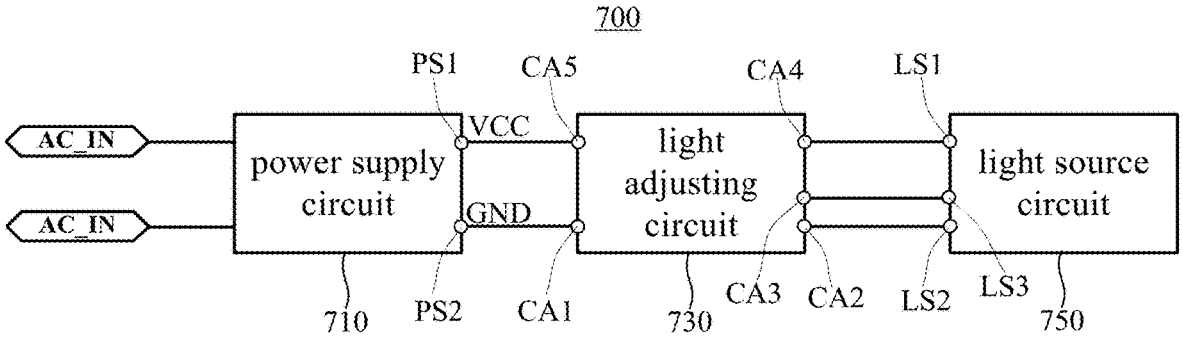
FIG. 7 is a schematic circuit block diagram of a light source device according to a third embodiment of the disclosure.

Referring to FIG. 7, a light source device 700 in the third embodiment of the disclosure includes: a power supply circuit 710, a light adjusting circuit 730, and a light source circuit 750.

The power supply circuit 710 has AC input terminals AC_IN and voltage terminals PS1 and PS2. The voltage terminal PS1 is for example a DC output terminal VCC, the voltage terminal PS2 is for example a ground terminal GND. Furthermore, an output current of the power supply circuit 710 in the embodiment is constant, or the power supply circuit 710 is called as a constant current output power supply circuit, which can be an conventional mature constant current power supply such as an LED constant current drive power supply with a DC voltage of 24V-36V, there are no more details here.

The light adjusting circuit 730 has power connection terminals CA1 and CA5, a plurality of light source branch connection terminals such as CA2 and CA3, and a light source common connection terminal CA4. The power connection terminal CA1 is electrically connected to the voltage terminal PS2 of the power supply circuit 710 such as the ground terminal GND, the power connection terminal CA5 is electrically connected to the voltage terminal PS1 of the power supply circuit 710 such as the DC output terminal VCC.

The light source circuit 750 has a common terminal LS1 and a plurality of branch terminals such as LS2 and LS3. The common terminal LS1 is electrically connected to the light source common connection terminal CA4 of the light adjusting circuit 730; the branch terminals LS2 and LS3 are respectively electrically connected to the light source branch connection terminals CA2 and CA3 of the light adjusting circuit 730.

Figure 8:
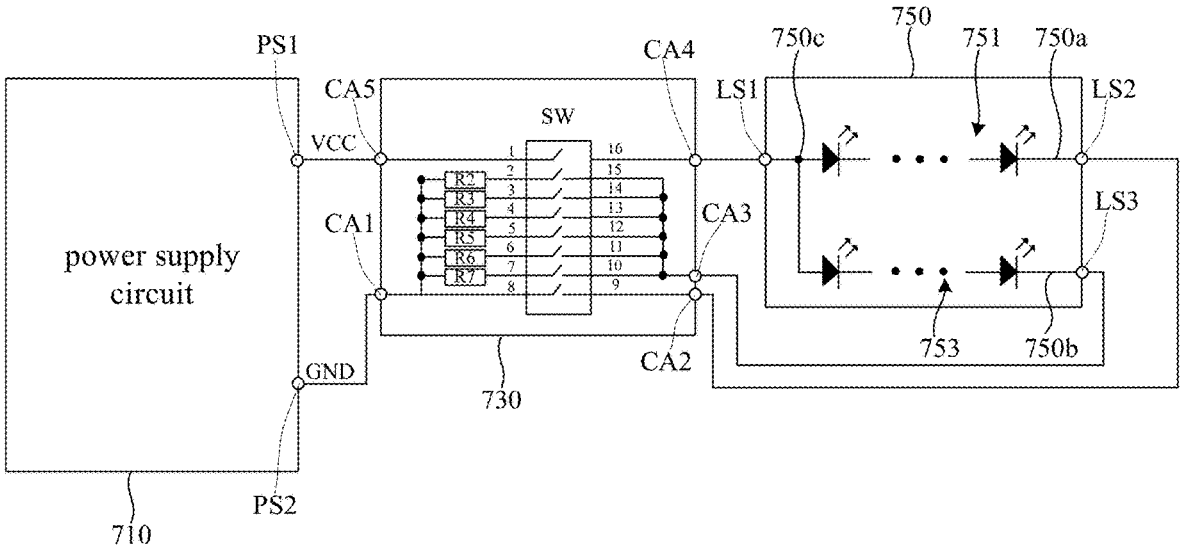
FIG. 8 is a schematic circuit diagram of a specific implementation of the light source device shown in FIG. 7.

Referring to FIG. 8, it is a specific implementation of the light source device 700 shown in FIG. 7. In FIG. 8, the light source circuit 750 includes a light source 751 and a light source 753, and the light source 751 and the light source 753 are configured for emitting lights of different colors; for example, a light emitted from the light source 751 is a white light with a color temperature of 2700K, and a light emitted from the light source 753 is a white light with a color temperature of 5000K. The light source 751 and the light source 753, for example respectively have LED lamp strings of a same number or different numbers of serially connected LED lamps, a voltage of one of the LED lamps (or called as a junction voltage) is for example 3V or 9V. Furthermore, terminals 750*c* of the light sources 751 and 753 is electrically connected to the common terminal LS1, terminals 750*a* and 750*b* of the light sources 751 and 753 are electrically connected to the branch terminals LS2 and LS3 respectively.

By above, in FIG. 8, the light adjusting circuit 730 includes two electrical paths, one of the two electrical paths is connected between the power connection terminal CA1 and the light source branch connection terminal CA2 so as to be connected serially with the light source 751 between the DC output terminal VCC and the ground terminals GND, the other one of the two electrical paths is connected between the power connection terminal CA1 and the light source branch connection terminal CA3 so as to be connected serially with the light source 753 between the DC output terminal VCC and the ground terminal GND. Concretely, the electrical path connected between the power connection terminal CA1 and the light source branch connection terminal CA2 includes one switch unit in a multi-channel switch SW and becomes a electrical path with a fixed resistance. The electrical path connected between the power connection CA1 and the light source branch connection CA3 includes six electrical sub-paths connected in parallel, the six electrical sub-paths respectively include six switch units in the multi-channel switch SW and resistors R2, R3, R4, R5, R6 and R7 respectively connected serially with the six switch unit. In addition, another switch unit in the multi-channel switch SW configured as a main switch is further connected between the power connection terminal CA5 and the light source common connection terminal CA4. The multi-channel switch here is for example an eight-digit dial switch. In other alternative embodiment(s), the six switch units in the electrical path connected between the power connection terminal CA1 and the light source branch connection terminal CA3 may also be realized by a single six-channel rotary switch. Furthermore, resistance of one of the two electrical paths in the light adjusting circuit 730 of the light source device shown in FIG. 8 is adjustable, the electrical path is for example an electrical path of six-level adjustable resistance; however a resistance of the other one of the two electrical paths is fixed and non-adjustable.

Figure 9:
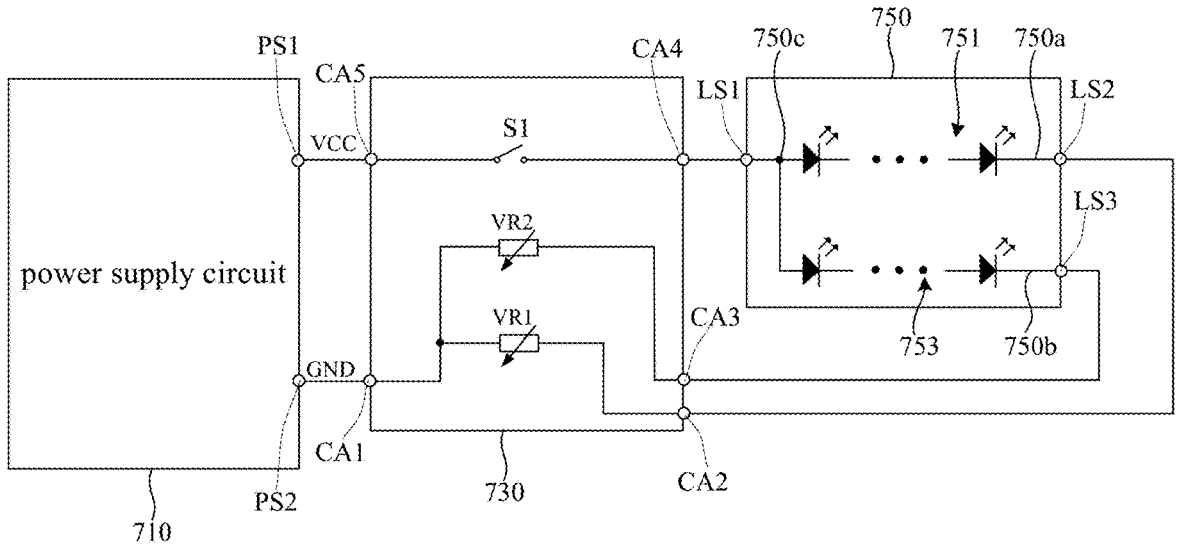
FIG. 9 is a schematic circuit diagram of another specific implementation of the light source device shown in FIG. 7.

Referring to FIG. 9, it is another specific implementation of the light source device 700 shown in FIG. 7. In FIG. 9, regarding the light adjusting circuit 730, the electrical path connected between the power connection terminal CA1 and the light source branch connection terminal CA2 is disposed with an adjustable resistor VR1, so that a resistance of the electrical path is adjustable. Similarly, the electrical path connected between the power connection terminal CA1 and the light source branch connection terminal CA3 is disposed with an adjustable resistor VR2, so that a resistance of the electrical path is adjustable. Additionally, the light adjusting circuit 730 further includes a main switch (or called as a master switch) S1 which is connected between the power connection terminal CA5 and the light source common connection terminal CA4.

Figure 10:
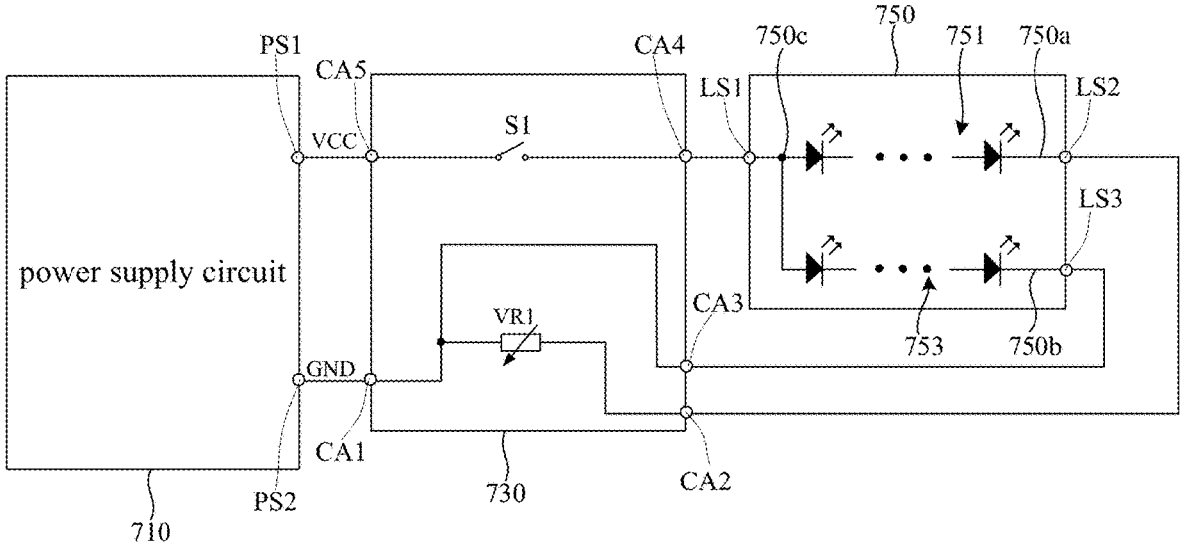
FIG. 10 is a schematic circuit diagram of still another specific implementation of the light source device shown in FIG. 7.

Referring to FIG. 10, it is another specific implementation of the light source device 700 shown in FIG. In FIG. 10, regarding the light adjusting circuit 730, the electrical path connected between the power supply connection CA1 and the light source branch connection CA2 is disposed with the adjustable resistor VR1, so that a resistance of the electrical path is adjustable; however, a resistance of the electrical path connected between the power connection terminal CA1 and the light source branch connection terminal CA3 is fixed, so that the resistance of the electrical path is non-adjustable. Furthermore, the light adjusting circuit 730 further includes a main switch S1 connected between the power connection terminal CA5 and the light source common connection terminal CA4.

In the light source device 700 aforementioned of this embodiment, the plurality of light sources such as 751 and 753 in the light source circuit 750 are connected in parallel between the voltage terminal PS1 and the voltage terminal PS2 of the power supply circuit 710 through respective electrical paths in the light adjusting circuit 730, that is the light adjusting circuit 730 configured as a multi-level color adjustment control circuit is established between the power supply circuit 710 and the light source circuit 750, magnitudes of branch currents flowing through the light sources such as 751 and 753 in the light source circuit 750 are adjustable by adjusting resistances of the electrical path(s) with adjustable resistance(s) in the light adjusting circuit 730; and the light adjusting circuit 730 configured as a multi-level color adjustment control circuit does not need to include a MCU and a MOS transistor(s) and other electronic components with relatively high cost. In this way, design of the light source device 700 of multi-level color adjustment can be more flexible, which saves design time, and cost of the light source device 700 such as an LED light source can be reduced, good economic and social benefits are created while more material resources are saved. Taking the light source 751 as an LED white light source with a color temperature of 2700K and the light source 753 as another LED white light source with a color temperature of 5000K as an example, by adjusting resistance(s) of the electrical path(s) of adjustable resistance(s), mixed white lights with 3000K color temperature, 4500K color temperature or other color temperatures between 2700K-5000K can be formed with a constant total output current I of the power supply circuit 710. In addition, the aforementioned color temperatures of 2700K and 5000K can be extended to any color temperature or even a colored light used for an LED grow light. The realization method of the colored light used for the LED grow light for example is as follows: when two light sources of 660 nm (deep red) and 730 nm (far red) are used, a light quantum ratio (color matching) of a flowering stage of a plant is 4:1, and another light quantum ratio of a fruiting period of the plant is 5:2; or when two light sources of 460 nm (blue) and 660 (dark red) are used, a light quantum ratio (color matching) of a nursery period of a plant is 3:2, and another photon ratio of a leaf growing period of the plant is 2:1; but this disclosure does not take these as limits.

Furthermore, the light source device 700 of the embodiment of the disclosure can be applied to most bulbs and lamps with requirement for multi-level color adjustment function, such as panel light (FPL2), downlight, spotlight, ceiling light, track light, strip lamp, plant bulb, plant lamp, etc.

It can be understood that the foregoing embodiments are only exemplary illustration of the disclosure, the technical solutions of the embodiments can be arbitrarily combined and be used under the premise that the technical features do not conflict, the structures do not contradict, and purpose of the disclosure is not violated. Besides, it is worth mentioning that the light adjusting circuits 130 and 730 in the embodiments of the disclosure do not exclude implementation(s) of providing active elements (such as active switches); furthermore, the numbers of light sources in the light source circuits 150 and 750 are not limited to two, and type of light source is not limited to LED light source; moreover, magnitudes of electrical paths in the light adjusting circuits 130 and 730 are not limited to the two listed above, further may be more than two electrical paths disposed with more than two light sources.

The above are only preferred embodiments of the disclosure, and do not limit the disclosure in any form, although the disclosure has been disclosed in the preferred embodiments as above, it is not intended to limit the disclosure, any person skilled in the art, without departing from the scope of the technical solutions of the disclosure, can use the technical contents disclosed above to make some alterations or modifications to equivalent embodiments of equivalent changes, but if they do not deviate from the technical solution contents of the disclosure, any simple modifications, equivalent changes made to the above embodiments by the technical essence of the disclosure still fall within the scope of the technical solutions of the disclosure.

What is claimed is:

1. A light source device comprising:

a power supply circuit, having a first voltage terminal and a second voltage terminal;

a light source circuit, having a common terminal and a plurality of branch terminals, wherein the common terminal is electrically connected to the first voltage terminal, the light source circuit comprises a plurality of light sources configured for emitting lights of different colors, first terminals of the plurality of light sources are electrically connected to the common terminal, and second terminals of the plurality of light sources are electrically connected to the plurality of branch terminals respectively; and a light adjusting circuit, comprising a power connection terminal, a plurality of light source branch connection terminals and a plurality of electrical paths, wherein the power connection terminal is electrically connected to the second voltage terminal, the plurality of light source branch connection terminals are respectively connected to the plurality of branch terminals, first terminals of the plurality of electrical paths are electrically connected to the plurality of light source branch connection terminals respectively and second terminals of the plurality of electrical paths are electrically connected to the power connection terminal and thereby the plurality of light sources are connected in parallel between the first voltage terminal and second voltage terminal;

wherein a resistance of at least one of the plurality of electrical paths is adjustable to thereby set magnitudes of branch currents respectively flowing through the plurality of light sources;

wherein the plurality of light sources comprise a first light source and a second light source, the plurality of electrical paths comprise a first electrical path and a second electrical path, the first electrical path is electrically connected to the first light source through corresponding one of the plurality of light source branch connection terminals, the second electrical path is electrically connected to the second light source through corresponding one of the plurality of light source branch connection terminals, the resistance of the first electrical path is adjustable and the first electrical path comprises a first switch cooperative with a plurality of resistors of different resistances to form a plurality of electrical sub-paths connected in parallel, and the second electrical path comprises a second switch.

2. The light source device as claimed in claim 1, wherein the first switch comprises a plurality of switch units in a multi-channel switch, at least a part of the plurality of switch units with the plurality of resistors of different resistances together form the plurality of electrical sub-paths connected in parallel, and the second switch comprises one or more than one switch unit in the multi-channel switch.

3. The light source device as claimed in claim 1, wherein the resistance of the second electrical path is adjustable, and the second switch with a plurality of another resistors of different resistances together form a plurality of another electrical sub-paths connected in parallel.

4. The light source device as claimed in claim 1, wherein the resistance of the second electrical path is non-adjustable.

5. The light source device as claimed in claim 1, wherein the light adjusting circuit further comprises a second power connection terminal, a light source common connection terminal and a third switch electrically connected between the second power connection terminal and the light source common connection terminal; the second power connection terminal is electrically connected to the first voltage terminal, and the light source common connection terminal is electrically connected to the common terminal.

6. The light source device as claimed in claim 1, wherein the first voltage terminal is one of a direct current (DC) output terminal and a ground terminal, and the second voltage terminal is the other one of the DC output terminal and the ground terminal.

7. The light source device as claimed in claim 1, wherein the first light source and the second light source respectively comprise a same number or different numbers of serially connected light emitting diodes, and a voltage difference between the first light source and the second light source is 0-5 times of a junction voltage of one of the light emitting diodes.

8. The light source device as claimed in claim 7, wherein a resistor for color-adjustment required for adjusting the first light source and the second light source to form a mixed light with a target color temperature satisfies a relationship that: $Rx=(Vr/I)*K$, where Rx represents resistance of the resistor for color-adjustment, Vr represents the voltage difference, I represents a total current flowing through the plurality of light sources, and K represents a branch current adjustment coefficient.

9. A light source device comprising:

a power supply circuit, having a first voltage terminal and a second voltage terminal;

a light source circuit, having a common terminal and a plurality of branch terminals, wherein the common terminal is electrically connected to the first voltage terminal, the light source circuit comprises a plurality of light sources configured for emitting lights of different colors, first terminals of the plurality of light sources are electrically connected to the common terminal, and second terminals of the plurality of light sources are electrically connected to the plurality of branch terminals respectively; and a light adjusting circuit, comprising a power connection terminal, a plurality of light source branch connection terminals and a plurality of electrical paths, wherein the power connection terminal is electrically connected to the second voltage terminal, the plurality of light source branch connection terminals are respectively connected to the plurality of branch terminals, first terminals of the plurality of electrical paths are electrically connected to the plurality of light source branch connection terminals respectively and second terminals of the plurality of electrical paths are electrically connected to the power connection terminal and thereby the plurality of light sources are connected in parallel between the first voltage terminal and second voltage terminal;

wherein a resistance of at least one of the plurality of electrical paths is adjustable to thereby set magnitudes of branch currents respectively flowing through the plurality of light sources;

wherein the plurality of light sources comprise a first light source and a second light source, the plurality of electrical paths comprise a first electrical path and a second electrical path, the first electrical path is electrically connected to the first light source through corresponding one of the plurality of light source branch connection terminals, the second electrical path is electrically connected to the second light source through corresponding one of the plurality of light source branch connection terminals, and at least one of the first electrical path and the second electrical path is disposed with an adjustable resistor;

wherein the light adjusting circuit further comprises a second power connection terminal, a light source common connection terminal and a main switch electrically connected between the second power connection terminal and the light source common connection terminal; the second power connection terminal is electrically connected to the first voltage terminal, and the light source common connection terminal is electrically connected to the common terminal.

10. The light source device as claimed in claim 9, wherein the first electrical path and the second electrical path are disposed with adjustable resistors respectively.

11. A light source device comprising:

a power supply circuit, having a first voltage terminal and a second voltage terminal;

a light source circuit, having a common terminal and a plurality of branch terminals, wherein the common terminal is electrically connected to the first voltage terminal, the light source circuit comprises a plurality of light sources configured for emitting lights of different colors, first terminals of the plurality of light sources are electrically connected to the common terminal, and second terminals of the plurality of light sources are electrically connected to the plurality of branch terminals respectively; and a light adjusting circuit, comprising a power connection terminal, a plurality of light source branch connection terminals and a plurality of electrical paths, wherein the power connection terminal is electrically connected to the second voltage terminal, the plurality of light source branch connection terminals are respectively connected to the plurality of branch terminals, first terminals of the plurality of electrical paths are electrically connected to the plurality of light source branch connection terminals respectively and second terminals of the plurality of electrical paths are electrically connected to the power connection terminal and thereby the plurality of light sources are connected in parallel between the first voltage terminal and second voltage terminal;

wherein a resistance of at least one of the plurality of electrical paths is adjustable to thereby set magnitudes of branch currents respectively flowing through the plurality of light sources;

wherein the light adjusting circuit further comprises a second power connection terminal, a light source common connection terminal and a main switch electrically connected between the second power connection terminal and the light source common connection terminal; the second power connection terminal is electrically connected to the first voltage terminal, and the light source common connection terminal is electrically connected to the common terminal.

* * * * *